United States Patent [19]

Greiner et al.

[11] 4,175,102

[45] Nov. 20, 1979

[54] FUEL SUPPLY DEVICE

[75] Inventors: Max Greiner, Gerlingen; Klaus J. Peters, Affalterbach; Peter Schelhas, Stuttgart; Peter Stiefel, Ditzingen; Hermann Nusser, Asperg, all of Fed. Rep. of Germany

[73] Assignee: Robert Bosch GmbH, Stuttgart, Fed. Rep. of Germany

[21] Appl. No.: 897,985

[22] Filed: Apr. 20, 1978

[30] Foreign Application Priority Data

May 6, 1977 [DE] Fed. Rep. of Germany ..... 2720336

[51] Int. Cl.[2] ..... F02M 7/22

[52] U.S. Cl. ..... 261/50 A; 261/44 A; 261/44 G; 123/139 AW

[58] Field of Search ..... 261/50 A, 44 A, 44 G, 261/44 E; 123/139 AW

[56] References Cited

U.S. PATENT DOCUMENTS

| | | | |
|---|---|---|---|
| 677,283 | 6/1901 | Secor | 261/44 G |
| 1,951,262 | 3/1934 | Townsley | 261/44 A |
| 2,895,723 | 7/1959 | Weiland | 261/44 A |
| 3,711,068 | 1/1973 | Perry | 261/44 A |
| 3,953,547 | 4/1976 | Schoeman | 261/50 A |
| 4,064,847 | 12/1977 | Holzbaur et al. | 261/44 A |
| 4,079,718 | 3/1978 | Holzbaur | 261/44 A |
| 4,094,933 | 6/1978 | Schoeman | 261/50 A |

FOREIGN PATENT DOCUMENTS

| | | | |
|---|---|---|---|
| 908084 | 11/1956 | Fed. Rep. of Germany | 261/44 G |
| 924002 | 1/1957 | Fed. Rep. of Germany | 261/44 G |
| 2352964 | 4/1975 | Fed. Rep. of Germany | 123/139 AW |
| 2307136 | 4/1976 | France | 261/44 A |
| 615170 | 1/1961 | Italy | 261/44 A |
| 1278292 | 6/1972 | United Kingdom | 261/44 E |

*Primary Examiner*—Tim R. Miles

*Attorney, Agent, or Firm*—Edwin E. Greigg

[57] ABSTRACT

A fuel supply device, which serves to predetermine a fuel quantity that is proportional to the aspirated air quantity, and also serves to spread the air-fuel mixture. The fuel supply device includes an air metering device, which is arranged in the air intake manifold of the internal combustion engine and activates a fuel metering device, which has a control slit that opens a control groove by a varying amount. The control slit and the control groove are rotatable relative to each other, and the control groove has at least one control edge, which overlaps the control slit and is formed at an angle relative to the axis of rotation. The control slit is arranged in a guide sleeve and the control groove is arranged in a rotatable sleeve mounted in the guide sleeve with the rotatable sleeve being arbitrarily shifted relative to the guide sleeve. A connecting tube is arranged between the rotatable sleeve and the mounting axis of the air metering device, by means of which the metered fuel can be fed to a nozzle arranged on the air flow rate meter. For a better mixture spreading effect, air can be fed to the metered fuel through a filter composed of a fine-meshed web.

6 Claims, 4 Drawing Figures

FUEL SUPPLY DEVICE

BACKGROUND OF THE INVENTION

The invention relates to a fuel supply device for mixture-compressing, externally ignited internal combustion engines with a throttle member arranged in the air intake manifold so as to be arbitrarily activatable, and an air metering member, which is deflected against a return force according to the air flow rate and thereby activates a fuel metering device. In addition, the fuel metering device has a control slit, which, in turn, opens a control groove to a greater or lesser degree to meter the fuel and the metered fuel quantity is injected into the air intake manifold, especially by means of a nozzle. A fuel supply device is already known in which only a relatively rough adjustment of the basic setting of the fuel metering device which belongs to the fuel supply device is possible. In addition, the rigid coupling between the air metering member and the fuel metering device does not allow the exchange or replacement of these individual assemblies to adapt to various internal combustion engine values. The danger also exists that a portion of the fuel may enter the air intake manifold upstream of the air metering member in an undesirable manner through the air line that is intended to supply air so as to better spread the fuel mixture.

OBJECT AND SUMMARY OF THE INVENTION

The fuel supply device according to the invention has the advantage of a finely-adjustable, tight and inexpensive assembly for adjusting the basic setting of the fuel metering device, which thereby results in a substantially better correlation between the setting of the air metering member according to the aspirated air quantity and the fuel quantity that is metered by the fuel metering device.

Especially advantageous is the arrangement according to the invention of a connecting tube that is provided between the fuel metering device and the mounting axis of the air metering member. This connecting tube allows, with limited play, a greater degree of movement while maintaining good mountability on the internal combustion engine.

Also, a further advantage is the novel fuel return prevention in the air line that is intended to deliver spreading air into the metered fuel quantity through a filter.

The invention will be better understood as well as further objects and advantages thereof become more apparent from the ensuing detailed description of the preferred embodiments taken in conjunction with the drawings.

DESCRIPTION OF THE PREFERRED EMBODIMENT

Figure 1:
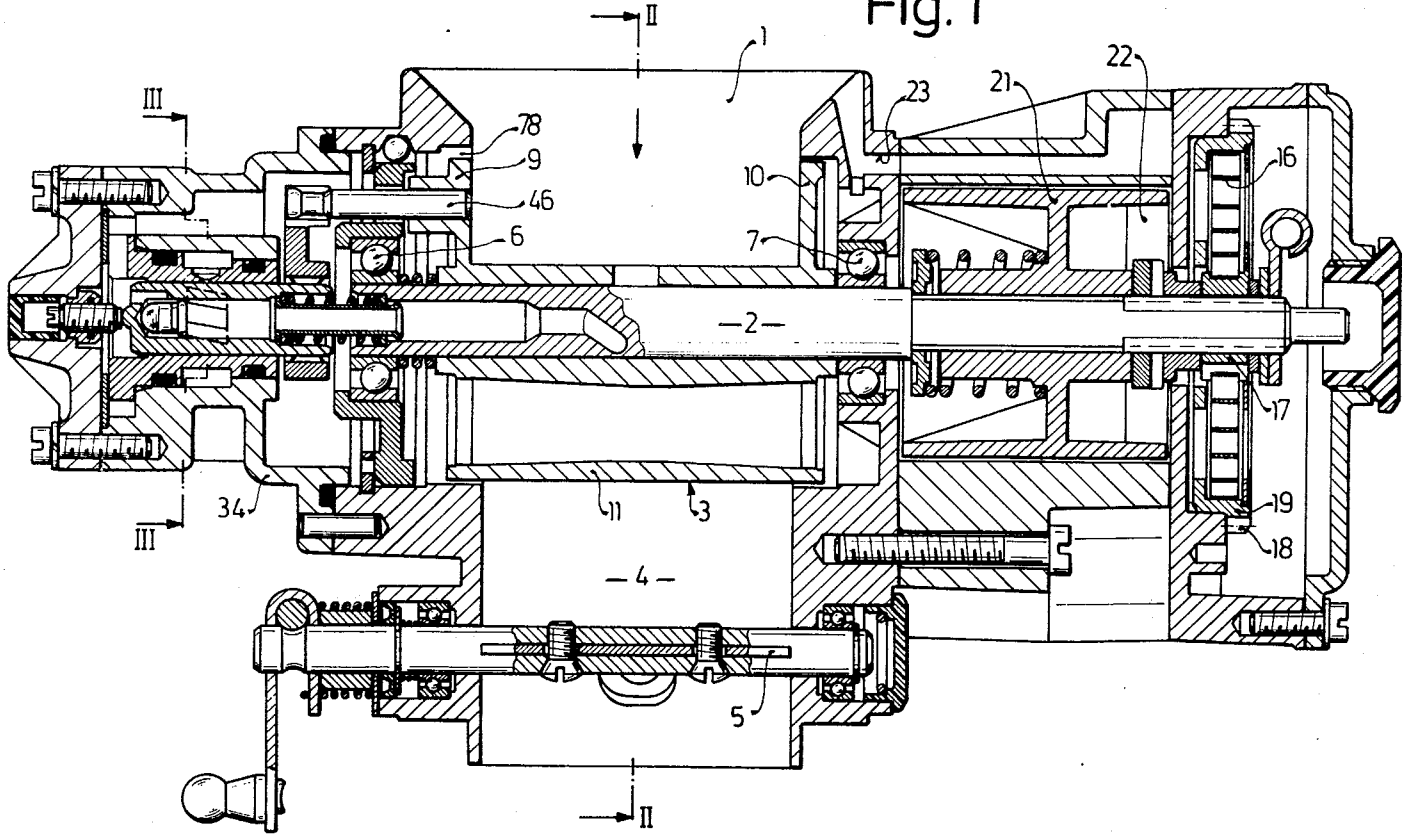
FIG. 1 shows a horizontal cross sectional view through a fuel supply device.
Figure 1A:
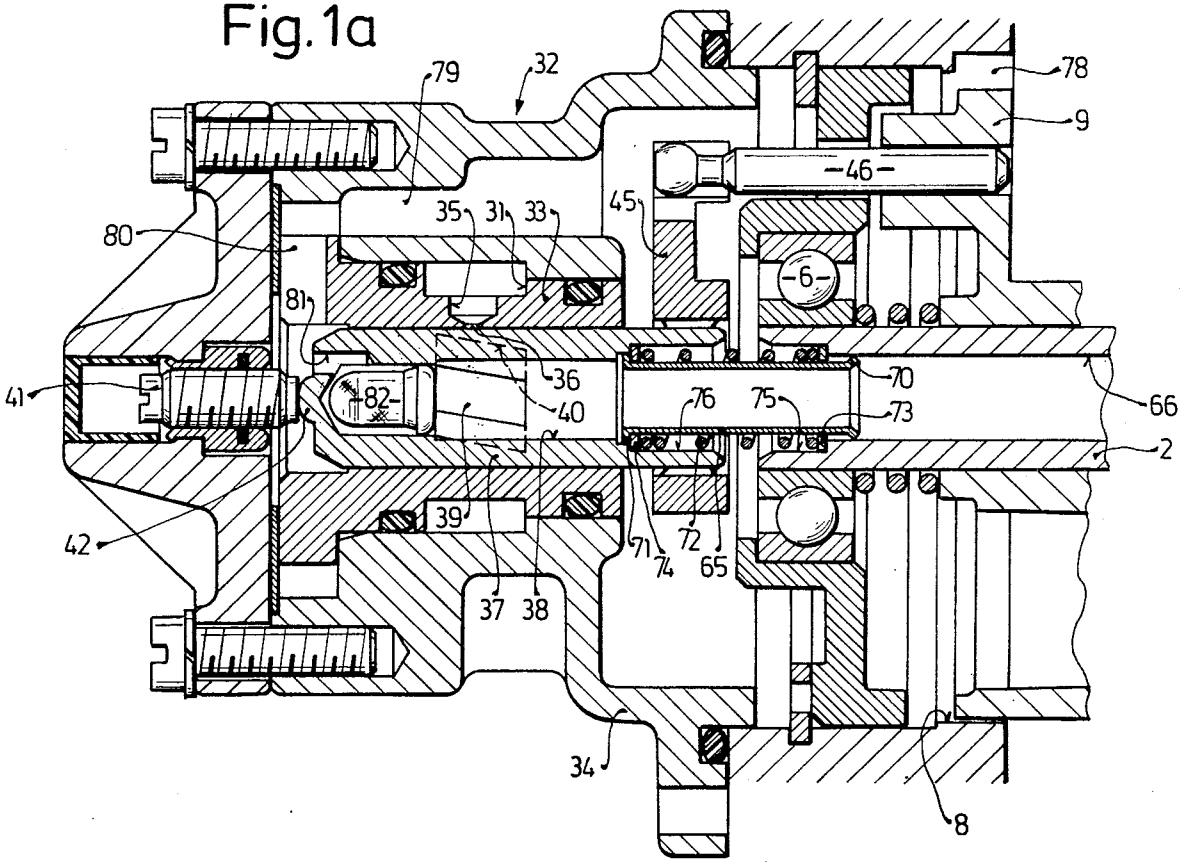
FIG. 1*a* is an enlarged sectional view of a portion of the fuel supply device according to FIG. 1.

In the fuel supply device for a mixture compressing, externally ignited internal combustion engine shown in FIGS. 1 and 1*a*, the combustion air flows through an air filter (not shown) in the direction of the arrow into a section 1 of the air intake manifold, which contains a body 3 rotatably mounted on a shaft 2, which is formed as an air metering member and adapted for metering the air quantity aspirated by the internal combustion engine. The combustion air then flows through a section 4 of the intake manifold, which contains an arbitrarily activatable throttle valve 5 and into one or more cylinders (not shown) of the internal combustion engine. The hollow shaft 2, which is rigidly connected with the air metering member 3, is positioned in the wall of the air intake manifold section 1 by means of ball bearings 6 and 7. The air metering member 3 which includes oppositely disposed cylindrical end walls 9 and 10 is arranged to extend across the air intake manifold 1 and into the recesses as shown in FIG. 1. One such recess is indicated at 8 in FIG. 1*a*. The air metering member 3 also includes a cover section 11 that is adapted to control the flow cross section of the air intake manifold section 1.

Figure 2:
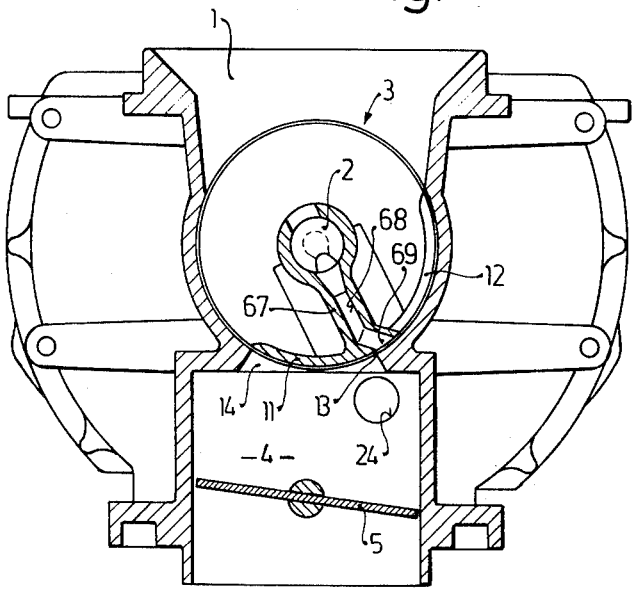
FIG. 2 is a sectional view along the line II—II of FIG. 1.

As shown in FIG. 2, a flow opening 12 having an air metering control edge 13 is machined into the cylindrical shell section 11 of the air intake manifold. The cylindrical shell section 11 of the air metering member 3 is formed in such a manner that the air intake manifold is closed by the shell section 11 when no air is flowing, and as the air aspiration rate increases, the air metering control edge 13 opens an aperture 14 of the air intake manifold to a greater degree. The cylindrical shell section 11 of the air metering member 3 is formed in such a manner that it completely blocks the aperture 14 when air is not flowing, but influences the air flow as little as possible in a position where the aperture 14 has been completely opened by the air metering control edge 13.

The clockwise deflection of the air metering member 3 takes place against the force of a sprial spring 16, which is connected on one of its ends with the mounting shaft 2 by means of a collar 17, and whose other end is connected with a ring 19, the exterior wall of which is provided with a toothed gear 18. The ring 19 can be rotated by a pinion member (not shown) that is arranged to cooperate with toothed gear 18, and can be arrested by setting screws which also are not shown.

Also connected with the mounting shaft 2 of the air metering member 3 is a damping sleeve 21, which is adapted to rotate in an annular chamber 22, the movement of said sleeve arranged to correspond to the rotational movement of the air metering member 3. The area indicated at 22 is divided into two chambers by the damping sleeve and a radial barrier is provided in the housing (not shown), with one of said chambers being arranged to communicate with the air intake manifold section 1 upstream of the air metering member 3 by means of a line 23, and the other chamber being arranged to communicate with the air intake manifold section 4 downstream of the air metering member by means of a line 24 and a throttling location (not shown). The arrangement of the damping sleeve 21 acts to damp the adjusting motion of the air metering member 3, so that the pressure fluctuations in the air intake manifold, which are caused by suction strokes, have practically no influence on the angular dispositionn of the air metering member 3. The air metering member 3 moves within the recess 8 of the air intake manifold section 1 according to a nearly linear function of the air quantity flowing through the air intake manifold. Thus, if the air pressure prevailing in front of.the air metering member 3 remains constant, the pressure prevailing between the air metering member and the throttle valve 5 will also remain constant.

Figure 3:
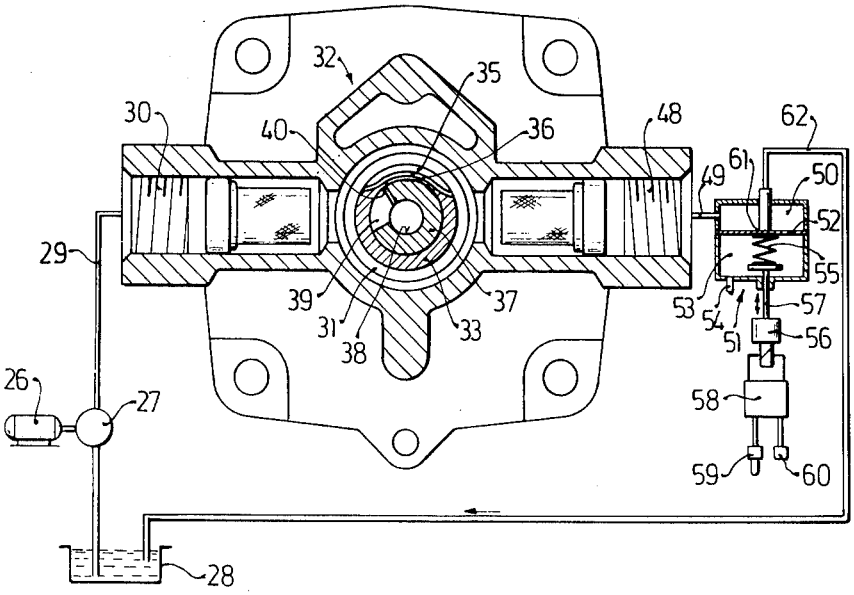
FIG. 3 is a sectional view along the line III—III of FIG. 1.

The fuel that is supplied to the fuel supply device takes place, as shown in FIG. 3, for example, by means of a fuel pump 27, which is driven by an electric motor 26, which pump aspirates the fuel from a fuel container 28 and leads it through a fuel supply line 29 to a nipple 30, and from there the fuel is fed into an annular groove 31 of the fuel metering device 32. The annular groove 31 is formed in a guide sleeve 33, which is rigidly mounted inside the housing 34 of the fuel metering device. The annular groove 31 communicates with a radial control slit 36 that is provided in the guide sleeve 33 by means of a supply recess 35. A rotatable sleeve 37, which has an inner bore 38 and a radially extending control groove 39, is mounted in the guide sleeve 33 so as to be capable of both rotational and slidable movement. The control groove 39 has at least one control edge 40, which opens the control slit 36 (FIG. 1*a*) to a greater or lesser degree depending on the position of the rotatable sleeve 37 relative to the guide sleeve 33. As shown by a broken line in FIG. 1*a*, the control edge 40 is formed at an angle to the central axis of the rotatable sleeve 37, so that the control slit 36 can be opened to a greater or lesser degree by the control edge 40 by means of an axial shifting of the rotatable sleeve with regard to the guide sleeve 33. In this manner the basic setting of the fuel metering device 32 can be adjusted. The axial shifting of the rotatable sleeve 37 can be accomplished in very small increments by means of an adjusting screw 41, which is arranged to engage a nose portion 42 provided at a terminal end of the rotatable sleeve 37 with as little friction as possible. The rotatable sleeve 37 and the air metering member 3 are connected by a coupling comprising a carrier member 45 that is connected with the rotatable sleeve 37 by a carrier bolt 46 which in turn is connected with the perforated wall 9 of the air metering member 3, so that a quantity of fuel that is proportional to the aspirated air quantity is delivered at the control slit 36 during rotational movement of the air metering member 3. It is effective to allow the carrier bolt 46 to engage in the carrier member 45 with as great a distance from the axis of rotation as possible, so that errors of delivery caused by the unavoidable play between the carrier bolt and the carrier member remain as low as possible.

The fuel metering at the control slit 36 of the fuel metering device takes place with a constant pressure differential. For this purpose the annular groove 31 communicates with a chamber 50 (FIG. 3) of a differential pressure valve 51 by means of an outlet nipple 48 and a line 49. The chamber 50 of the differential pressure valve 51 is separated from a chamber 53 of the differential pressure valve by a diaphragm 52, with the differential pressure valve being arranged to communicate with the air intake manifold section 1 upstream of the air metering member 3 by means of a line 54. A spring 55 is arranged in the chamber 53 and acts on the diaphragm 52 in the closing direction of the differential pressure valve. The force of the spring 55 can be altered in dependence on operational values of the internal combustion engine. An electromagnet 56 can serve this purpose. For example, a support for the spring 55 may be engaged by means of an activating rod 57 or an additional force that is independent of operational values can act directly on the diaphragm 52 in a direction that is parallel to the spring 55. The electromagnet 56 can, for example, be turned on by means of an electronic control device 58 by a signal from an oxygen sensor 59 that is arranged in the exhaust gas line of the internal combustion engine to measure the oxygen partial pressure or by the signal of a temperature indicator 60. The control of the force on the diaphragm 52 could, for example, also take place by means of a bimetallic spring in dependence on the operational temperature of the internal combustion engine. The differential pressure valve 51 is formed as a flat seat valve, having the diaphragm 52 which includes a rigid valve seat 61 as the movable valve element. Thus, with this arrangement excess fuel can flow into a return flow line 62, which empties into the fuel tank 28. The differential pressure valve simultaneously serves as the system pressure valve.

The fuel, which is metered at the control slit 36 of the fuel metering device 32, travels out of the inner bore 38 of the rotatable sleeve 37 through a connecting tubular member 65 into an axial bore 66 of the mounting shaft 2 of the air metering member 3, and from there flows through a line 68, (FIG. 2) which runs in a radial barrier 67 to the cylindrical shell shaped section 11 of the air metering member 3, thence to a nozzle 69 in direct proximity to the air metering control edge 13, so that it can be injected into the flow cross section of the aperture 14 that is opened by the air metering control edge 13 where the greatest air flow speed is found. This results in an excellent spreading of the injected fuel. The connecting tube 65, which is mounted on one side in the inner bore 38 of the rotatable sleeve 37 and on the other side in the axial bore 66 of the mounting shaft 2, includes annular outwardly extending collars 70 and 71 on each of its ends and adjacent thereto are positioned discs 73 and 74 that are held in spaced relation by a pressure spring 72. The discs 73 and 74 are pressed against the collars 70 and 71 by the pressure spring 72 when they are not mounted in the fuel supply device. However, when the connecting tube 65 is mounted in the fuel supply device, the discs 73 and 74 are supported in abutting relation with the termini of the opposed bores 75 and 76 that are provided in the hollow shaft 2 and the rotatable sleeve 37, respectively. Thus, it will be understood that the discs 73 and 74 are urged by the pressure spring against the stops provided by the end of the hollow shaft 2 and the rotatable sleeve 37. Accordingly, an excellent seal is assured with very little play despite the great freedom of movement allowed for the connecting tube. At the same time the rotatable sleeve 37 is axially fixed against the adjusting screw 41 that serves as a stop, all of which is accomplished by the force of the pressure spring 72.

To achieve an improved air-fuel mixture, it is practical to add the fuel that is metered at the control slit 36 of the fuel metering device 32 into the manifold through an air line before injection. For this purpose, air can travel from the air intake manifold section 1 upstream of the air metering member through an opening 78 that is provided between the wall 9 of the air metering member 3 and the recess 8 into a bore 79 and a radial bore 80 of the fuel metering device 32 and from there flows into a longitudinal bore 81, which opens into the inner bore 38 of the rotatable sleeve 37. In order to prevent fuel from being inadvertently discharged from the system, especially under small pressure differentials and large fuel quantities, a filter 82 having a fine-meshed web is arranged in the inner bore 38. The filter 82 with its fine-meshed web provides an obstacle for the fuel because of the large surface constraint, but air can easily pass through the longitudinal bore 81. The filter web can, for example, be made of fine metal or plastic threads. The filter 82 thereby serves as an inexpensive and effective method of preventing the metered fuel from returning upstream, while also providing passage for air that is to be added to the fuel for an improved spreading thereof by means of an air line.

The foregoing relates to preferred exemplary embodiments of the invention, it being understood that other embodiments and variants thereof are possible within the spirit and scope of the invention, the latter being defined by the appended claims.

What is claimed is:

1. A fuel supply device for mixture-compressing, externally ignited internal combustion engines provided with an arbitrarily activatable throttle member arranged in the air intake manifold, a fuel metering device, a rotatable air metering member associated with said throttle member adapted to actuate said fuel metering device, means for applying a return force to the air metering member that corresponds to the air flow rate, said air metering member being deflectable against said return force for actuation of said fuel metering device, said fuel metering device including a guide sleeve having a control slit, a rotatable sleeve having a control groove positioned within said guide sleeve, and arbitrarily slidable relative to said guide sleeve, said control groove being arranged to open said control slit to a greater or lesser degree and to thereby meter the fuel to a nozzle so as to be injected into the air intake manifold, coupling means for transferring the movement of said rotatable air metering member to said rotatable sleeve, secondary sleeve means for interconnecting said air metering member and said rotatable sleeve, said secondary sleeve means being arranged to receive the fuel to be fed to said nozzle, said control groove having at least one control edge portion which overlaps said control slit and is formed at an angle to the axis of rotation of said rotatable sleeve whereby said control groove is both rotatable and slidable relative to said control slit.

2. A fuel supply device as claimed in claim 1, further wherein said coupling means comprises a carrier member supported on said rotatable sleeve and bolt means associated with said air metering member is in communication therewith.

3. A fuel supply device in accordance with claim 1, wherein said rotatable sleeve includes a bore, a fine mesh filter means disposed in said rotatable sleeve bore, said filter means being adapted to permit the flow of air fed to said air metering member therethrough.

4. A fuel supply device as claimed in claim 1, further wherein said air metering member includes a hollow shaft at least one terminal end portion of which includes a bore in axial alignment with a bore provided in said rotatable sleeve, said secondary sleeve means being provided with further means to correlate the position thereof relative to said respective bores.

5. A fuel supply device as claimed in claim 4, further wherein the further means to correlate the position of said secondary sleeve means comprises encompassing disc members and an elastic element positioned therebetween.

6. A fuel supply device as claimed in claim 5, further wherein said disc members are arranged to be urged by said elastic element into said bores provided in said hollow shaft and said rotatable sleeve, respectively.

* * * * *